US008919762B2

(12) United States Patent
Horiuchi

(10) Patent No.: US 8,919,762 B2
(45) Date of Patent: Dec. 30, 2014

(54) PAPER SHEET PICKUP DEVICE AND PAPER SHEET PROCESSING APPARATUS

(71) Applicant: Kabushiki Kaisha Toshiba, Tokyo (JP)

(72) Inventor: Haruhiko Horiuchi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/190,679

(22) Filed: Feb. 26, 2014

(65) Prior Publication Data

US 2014/0239572 A1 Aug. 28, 2014

(30) Foreign Application Priority Data

Feb. 27, 2013 (JP) ..... 2013-037204

(51) Int. Cl.
*B65H 3/08* (2006.01)
*B65H 3/12* (2006.01)
*B65H 3/14* (2006.01)

(52) U.S. Cl.
CPC ..... *B65H 3/124* (2013.01); *B65H 2406/412* (2013.01); *B65H 2701/1916* (2013.01)
USPC ..... 271/96; 271/98; 271/108

(58) Field of Classification Search
CPC .... B65H 3/0808; B65H 3/0816; B65H 3/128; B65H 2406/14; B65H 2406/32; B65H 2406/322; B65H 2406/3222; B65H 2406/323; B65H 2406/365; B65H 3/124; B65H 2406/412; B65H 2701/1916
USPC ..... 271/96, 98, 108
See application file for complete search history.

(56) References Cited

U.S. PATENT DOCUMENTS

| | | | | |
|---|---|---|---|---|
| 3,558,126 | A * | 1/1971 | Jiruse | 271/98 |
| 3,884,460 | A * | 5/1975 | Jiruse | 271/98 |
| 3,999,795 | A * | 12/1976 | Barker | 294/185 |
| 4,089,518 | A * | 5/1978 | Vollrath | 271/167 |
| 4,583,729 | A * | 4/1986 | Blumle | 271/276 |
| 5,163,667 | A * | 11/1992 | Rebeaud | 271/98 |
| 8,430,397 | B2 | 4/2013 | Horiuchi et al. | |
| 2010/0270730 | A1 * | 10/2010 | Asari et al. | 271/108 |

FOREIGN PATENT DOCUMENTS

| | | |
|---|---|---|
| JP | 2010-215409 A | 9/2010 |
| JP | 2011-043183 A | 3/2011 |

* cited by examiner

*Primary Examiner* — David H Bollinger
(74) *Attorney, Agent, or Firm* — Baker Botts L.L.P.

(57) ABSTRACT

A paper sheet pickup device including a valve device is disclosed. The valve device includes a first air hole configured to be formed in a main body block to extend through it, have one end communicating with an air chamber and the other end connected to the negative pressure side of an air drawing source, a second air hole configured to be formed in a main body block to extend through it, have one end communicating with the air chamber and the other end connected to the positive pressure side of the air drawing source, and a rod-shaped valve member configured to be arranged in the main body block to cross the first air hole and the second air hole.

11 Claims, 7 Drawing Sheets

PAPER SHEET PICKUP DEVICE AND PAPER SHEET PROCESSING APPARATUS

CROSS-REFERENCE TO RELATED APPLICATIONS

This application is based upon and claims the benefit of priority from prior Japanese Patent Application No. 2013-37204, filed Feb. 27, 2013), the entire contents of which are incorporated herein by reference.

FIELD

Embodiments described herein relate generally to a paper sheet pickup device and paper sheet processing apparatus.

BACKGROUND

A paper sheet processing apparatus such as a postal item processing apparatus which handles postcards, letters, and the like includes, e.g., a pickup device, a determination device (OCR), a stacking device, a reject (RJ) stacking device, a switchback device, a conveyance path which connects the respective devices, and a gate which distributes conveyed paper sheets (postal items) to the respective devices. A plurality of paper sheets set at the supply portion of the pickup device are separated and picked up one by one by the pickup device, and fed to the determination device. The determination device determines the paper sheet, and decides the destination of the paper sheet, e.g., the RJ stacking device or the stacking device. After that, the paper sheet is conveyed to the chosen device via the conveyance path and gate mechanism, and undergoes various processes inside the device.

As the pickup device of the paper sheet processing apparatus, there has been provided a suction pickup device which sucks a paper sheet by a negative pressure and picks it up. This pickup device has an air suction structure which sucks a paper sheet by using a perforated belt, air chamber, and valve device. The pickup device can pick up, one by one, paper sheets fed from the supply portion by ON/OFF-controlling suction by the valve device for each paper sheet.

In the paper sheet pickup device using this air suction structure, suction and separation of a paper sheet with respect to the suction belt are performed by switching the inside of the air chamber installed on the rear surface of the suction belt between a negative pressure and a positive pressure. The pressure in the air chamber is switched by opening and closing the valve. In a conventional method, the air chamber and valve are installed at distant locations, and a pipe connecting the air chamber and valve is relatively long. For this reason, no negative pressure is generated in the air chamber until the air in the pipe is drawn, or the inside of the air chamber does not return to a positive pressure unless air is supplied into the pipe. Even if the valve itself operates quickly, time is taken to switch the inside of the air chamber between a positive pressure and a negative pressure. In addition, the inertia of a disk itself constituting the valve is large, which is disadvantageous for high-speed rotation and stopping. It is therefore difficult to suck and separate a paper sheet at a higher speed and stably pick it up at a higher speed.

DETAILED DESCRIPTION

According to one embodiment, a paper sheet pickup device includes an input portion, pickup member, air drawing source, and valve device. The valve device includes a main body block configured to be arranged on the rear surface side of the pickup member to face it, an air chamber configured to be formed in the main body block and be open to the pickup member, a first air hole configured to be formed in the main body block to extend through it, and have one end communicating with the air chamber and the other end connected to the negative pressure side of the air drawing source, a second air hole configured to be formed in the main body block to extend through it, and have one end communicating with the air chamber and the other end connected to the positive pressure side of the air drawing source, a rod-shaped valve member configured to be arranged in the main body block to cross the first air hole and the second air hole, and rotate to alternately open and close the first air hole and the second air hole, and a driving source configured to rotate the valve member.

A preferred embodiment of the present invention will now be described in detail with reference to the accompanying drawings.

Figure 1:
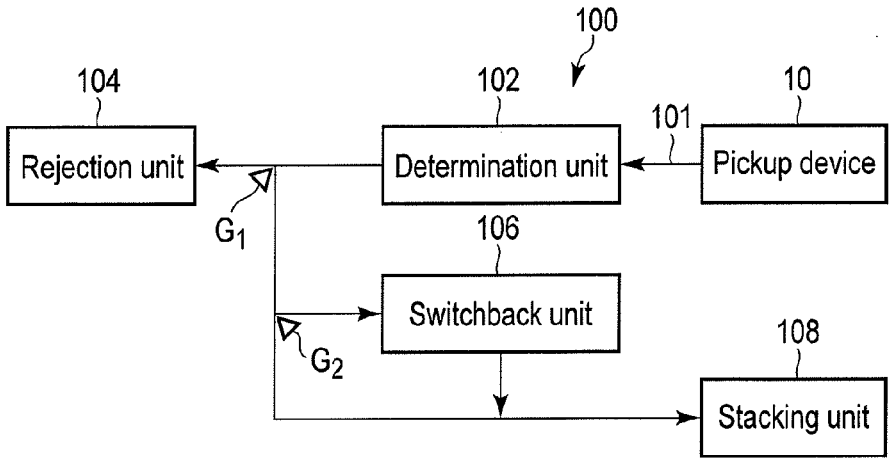
FIG. 1 is a block diagram schematically showing a postal item processing apparatus according to an embodiment.

FIG. 1 is a block diagram schematically showing a postal item processing apparatus (paper sheet processing apparatus) 100 including a paper sheet pickup device 10 according to the embodiment. In addition to the pickup device 10, the postal item processing apparatus 100 includes a determination unit 102, rejection unit 104, switchback unit 106, and stacking unit 108. Note that a paper sheet to be processed by the processing apparatus 100 according to the embodiment is a postal item, but a medium to be processed (i.e., a paper sheet) is not limited to a postal item.

A stack of postal items such as postcards or letters is set in the pickup device 10. The pickup device operates in a manner to be described later, picking up the postal items one by one onto a conveyance path 101. A plurality of pairs of endless conveyance belts (not shown) extend on the conveyance path 101 to sandwich it. The picked-up postal item is nipped and conveyed by the conveyance belts.

The postal item picked up on the conveyance path 101 is fed to the determination unit 102, and the determination unit 102 reads various kinds of information from the postal item. Based on the read various kinds of information, the determination unit 102 determines the conveyance posture, sorting destination, and the like of the postal item. In particular, the determination unit 102 determines a sorting destination by reading address information such as a postal code and address written on the postal item.

After passing through the determination unit 102, the conveyance direction of the postal item is distributed via a gate G1. More specifically, a postal item determined by the determination unit 102 to be a postal item to be rejected is conveyed to the rejection unit 104 via the gate G1, and stacked on the rejection unit. Other postal items are conveyed to the stacking unit 108 via the gate G1 and stacked inside the stacking unit 108.

At this time, when the determination unit 102 determines that the conveyance direction of a postal item needs to be reversed, the postal item is fed to the switchback unit 106 via the gate G1 and a gate G2 to reverse the conveyance direction. A postal item for which the conveyance direction need not be reversed detours the switchback unit 106 via the gate G2 and is conveyed to the stacking unit 108.

A postal item fed to the stacking unit 108 via the conveyance path 101 is sorted and stacked in a sorting stacking pocket (not shown) in accordance with the result of determination by the determination unit 102. Postal items are sorted and stacked in each sorting stacking pocket with their tops and bottoms being aligned.

Figure 2:
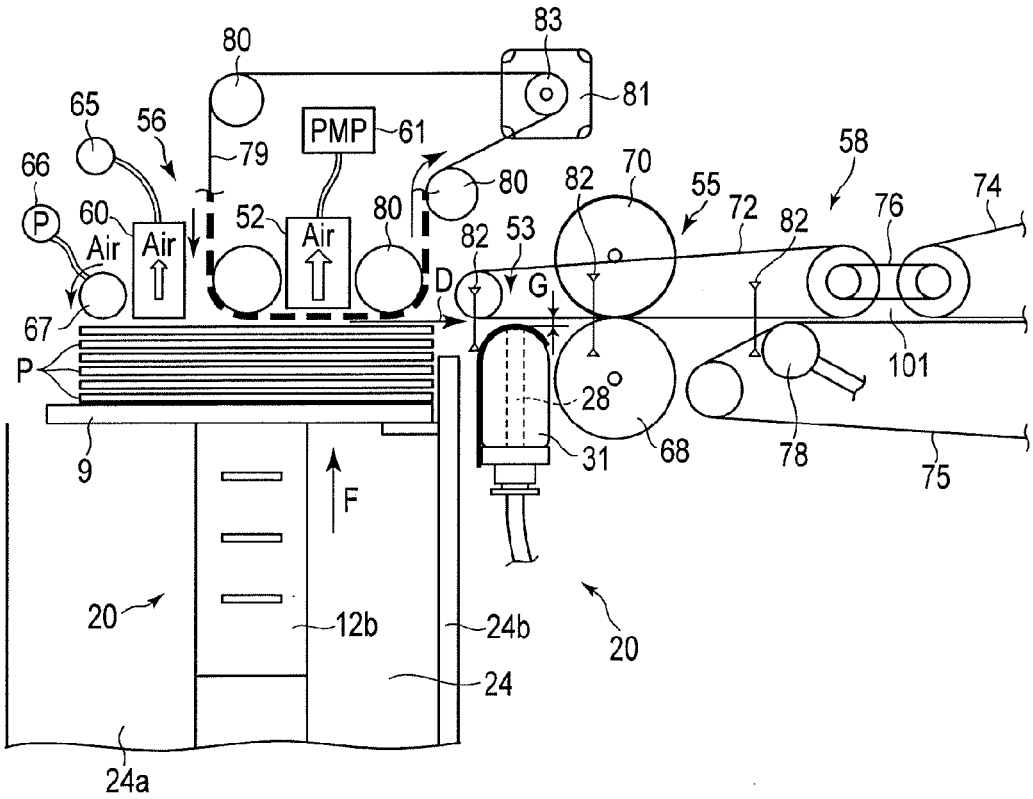
FIG. 2 is a plan view showing the pickup device of the postal item processing apparatus.
Figure 3:
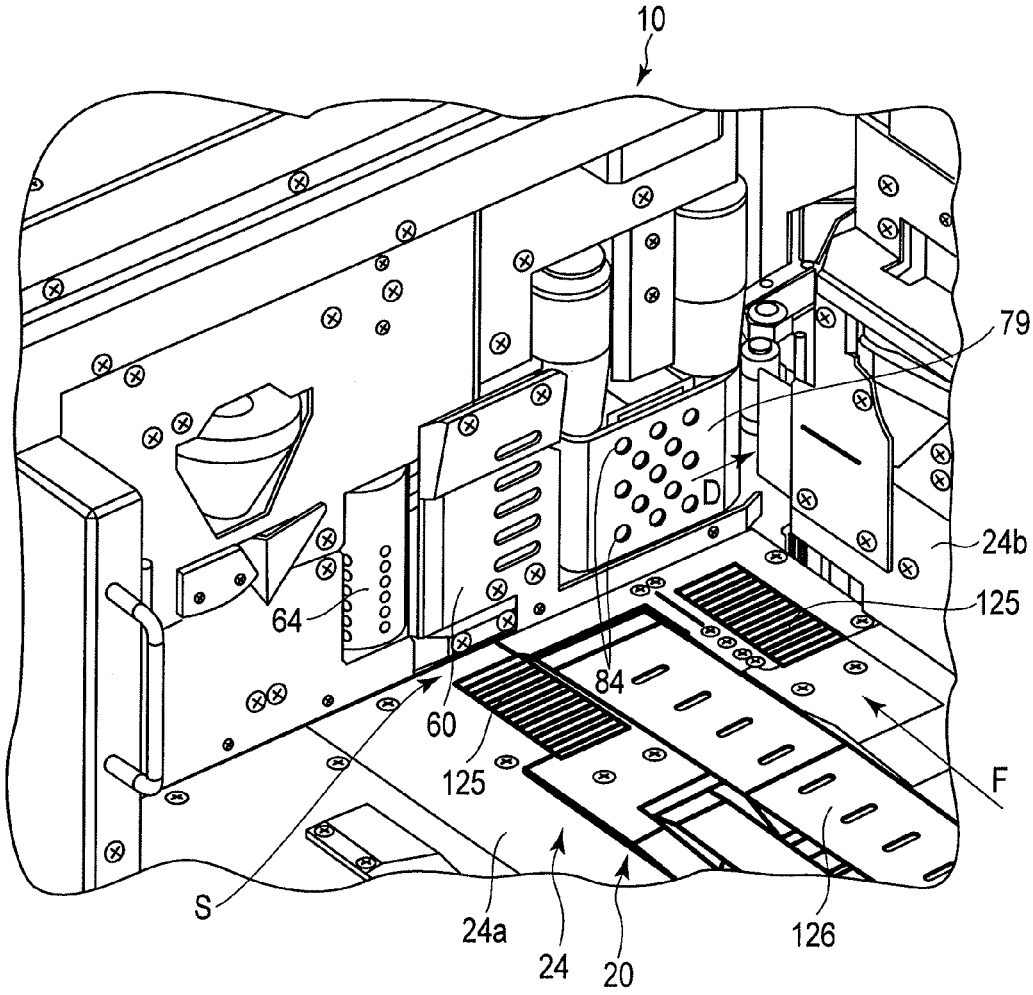
FIG. 3 is a perspective view showing the input portion and pickup mechanism of the pickup device.

Next, the paper sheet pickup device 10 will be explained in detail. FIG. 2 is a plan view showing the pickup device 10. FIG. 3 is a perspective view showing the pickup device. As shown in FIGS. 2 and 3, the pickup device 10 includes an input portion (supply portion) 24, supply mechanism 20, pickup mechanism 56, separation portion 53, gap correction portion 55, and conveyance mechanism 58. At the input portion 24, a stack of postal items P is set while each postal item stands almost perpendicularly to the horizontal plane. The supply mechanism 20 moves a plurality of input postal items P in the stacking direction to supply the postal item P at the leading end in a moving direction F to a pickup position S. The pickup mechanism 56 feeds the postal item P supplied to the pickup position S in the plane direction of the postal item P, in this case, a pickup direction D almost perpendicular to the moving direction F, and picks it up onto the conveyance path 101. The separation portion 53 separates, from the first postal item P, the second and subsequent postal items P accompanying the postal item P picked up from the pickup position S. The gap correction portion 55 corrects the gap between picked-up postal items. The conveyance mechanism 58 extracts, at a speed slightly higher than the pickup speed, the postal item P having passed through the gap correction portion 55, and conveys it downstream.

As shown in FIGS. 2 and 3, the input portion 24 includes a flat bottom wall 24*a*, a side wall (guide wall) 24*b* which stands almost perpendicularly, and a front wall. A stack of postal items P is placed together on the bottom wall 24*a* while they stand. One side edge of the postal items P is guided by the side wall 24*b*. A main belt 126 and a pair of sub-belts 125 are arranged on the bottom wall 24*a* of the input portion 24. The main belt 126 contacts the lower end side of each postal item P and feeds the postal item P in the stacking direction (direction indicated by the arrow F in FIGS. 2 and 3). The sub-belts 125 adjust the posture (tilt) of the postal item P. The main belt 126 and sub-belts 125 can be driven independently. The main belt 126 extends along almost the overall length of the input portion 24 in the feed direction F. The sub-belts 125 are arranged on the two sides of the main belt 126 near the pickup position S.

A backup plate 9 is arranged at a position where it contacts the surface of the postal item P at the back end in the moving direction among a plurality of postal items P. The backup plate 9 is simply connected to, e.g., the main belt 126. The backup plate 9 moves in the moving direction F in synchronism with the main belt 126 to push the postal items P toward the pickup position, thereby supplying the postal item P at the leading end in the moving direction to the pickup position S. The main belt 126, the sub-belts 125, the backup plate 9 and driving motors (to be described later) for driving the main belt and sub-belts function as the supply mechanism 20.

A plurality of paper sheets P are supported by the backup plate 9 and aligned along the side wall 24*b* on the main belt 126. A sensor (not shown) detects the presence/absence of the paper sheet P near the pickup position S. When there is no paper sheet P near the pickup position S, the backup plate 9 and main belt 126 move toward the pickup position to supply the paper sheet P at the leading end to the pickup position S.

As shown in FIGS. 2 and 3, the pickup mechanism 56 includes an air chamber 52, a vacuum pump 61 (or equivalent) serving as an air drawing source connected to the air chamber via a valve device (to be described later), an endless pickup belt 79 serving as a pickup member which sucks and picks up the postal item P, and a driving motor 81 which drives the pickup belt 79. A plurality of through holes (suction holes) 84 are formed in the pickup belt 79. The pickup belt 79 is wound and stretched around a plurality of pulleys 80 and a driving pulley 83 so that at least a partial region of the pickup belt 79 faces the postal item P present at the pickup position S and travels in the pickup direction D (pickup direction of the postal item P) along the pickup position S. The pickup belt 79 travels in a predetermined direction at a predetermined speed by the driving motor 81.

The air chamber 52 is positioned on the rear surface side of the pickup belt 79, i.e., on a side opposite to the postal item P so that the air chamber 52 is adjacent to and faces the postal item P. The vacuum pump 61 sets a negative or positive pressure in the air chamber 52. When a negative pressure is set, the air chamber 52 operates to suck and feed the postal item P by the pickup belt 79. When a positive pressure is set, the air chamber 52 operates to separate the postal item from the pickup belt without sucking the postal item P.

The pickup mechanism 56 includes a sub-chamber 60 arranged upstream of the pickup belt 79 in the pickup direction D, and a negative pressure generator (blower drawing side) 65 connected to the sub-chamber. The sub-chamber 60 operates to draw the postal item P at a position spaced apart from the sub-chamber 60 and move it to the pickup position S. In addition, the sub-chamber 60 operates to prevent pickup of two postal items by sucking and stopping the second postal item after the trailing end of the first postal item P passes through the sub-chamber 60.

Further, the pickup mechanism 56 includes an assist roller 67 arranged downstream of the sub-chamber 60 in the pickup direction D, and a vacuum pump 66 connected to the assist roller. The assist roller 67 has a structure in which holes are formed in the outer surface of the assist roller 67 and the assist roller 67 draws air from only a side facing the postal item P. The assist roller 67 sucks the postal item P and feeds it to the downstream side in the pickup direction D.

As shown in FIG. 2, the separation portion 53 includes a two-sheet pickup preventing block 31, and the preventing block faces a conveyance belt 72 at a gap G. An evacuation hole 28 is formed in the two-sheet pickup preventing block 31, and connected to a negative pressure generation device (vacuum pump) (not shown). When the pickup mechanism 56 simultaneously picks up two postal items P, the two-sheet pickup preventing block 31 sucks and stops the second postal item so that two postal items are not simultaneously fed to the gap correction portion 55.

The gap correction portion 55 includes a sponge roller 68 and drive roller 70 which are arranged to face each other via the conveyance path. The sponge roller 68 is an elastic flexible roller, and can deform due to a change of the thickness of the postal item P. The drive roller 70 is directly driven by an AC servo motor (not shown). The postal item P picked up by the pickup mechanism 56 is nipped between the sponge roller 68 and the drive roller 70. Rotation of the drive roller 70 is accelerated/decelerated in accordance with an instruction from a controller (not shown) to change the conveyance speed of the postal item P and adjust the interval (gap) from a preceding postal item P. More specifically, when the interval (gap) from a preceding postal item P is smaller than a predetermined value, the gap correction portion 55 decreases the conveyance speed of the postal item P to widen the interval (gap) from the preceding postal item. When the interval (gap) is larger than the predetermined value, the gap correction portion 55 increases the conveyance speed of the postal item P to narrow the interval.

As shown in FIG. 2, the conveyance mechanism 58 includes the endless conveyance belt 72, endless conveyance belts 74 and 75, and driving motors (not shown) for driving the conveyance belts 74 and 75. The conveyance belt 72 is rotated by the power of the conveyance belt 74 via a relay belt 76. The conveyance belts 72 and 74 are installed side by side along the conveyance path. The conveyance belt 75 is installed to face the conveyance belts 72 and 74 via the conveyance path. The postal item P picked up by the pickup mechanism 56 is conveyed by the conveyance belt 72 and the drive roller 70 of the gap correction portion 55. The postal item P is further nipped between the conveyance belts 74 and 75 and conveyed by them. A roller 78 arranged at a portion where the conveyance belt 75 faces the conveyance belt 72 is a spring tension roller. When a thick postal item P is conveyed to the conveyance mechanism 58, it pushes the spring tension roller 78 and is fed to the interval between the conveyance belts. Note that a plurality of sensors 82 are arranged on the conveyance path 101 to detect the passing postal item P.

Figure 4:
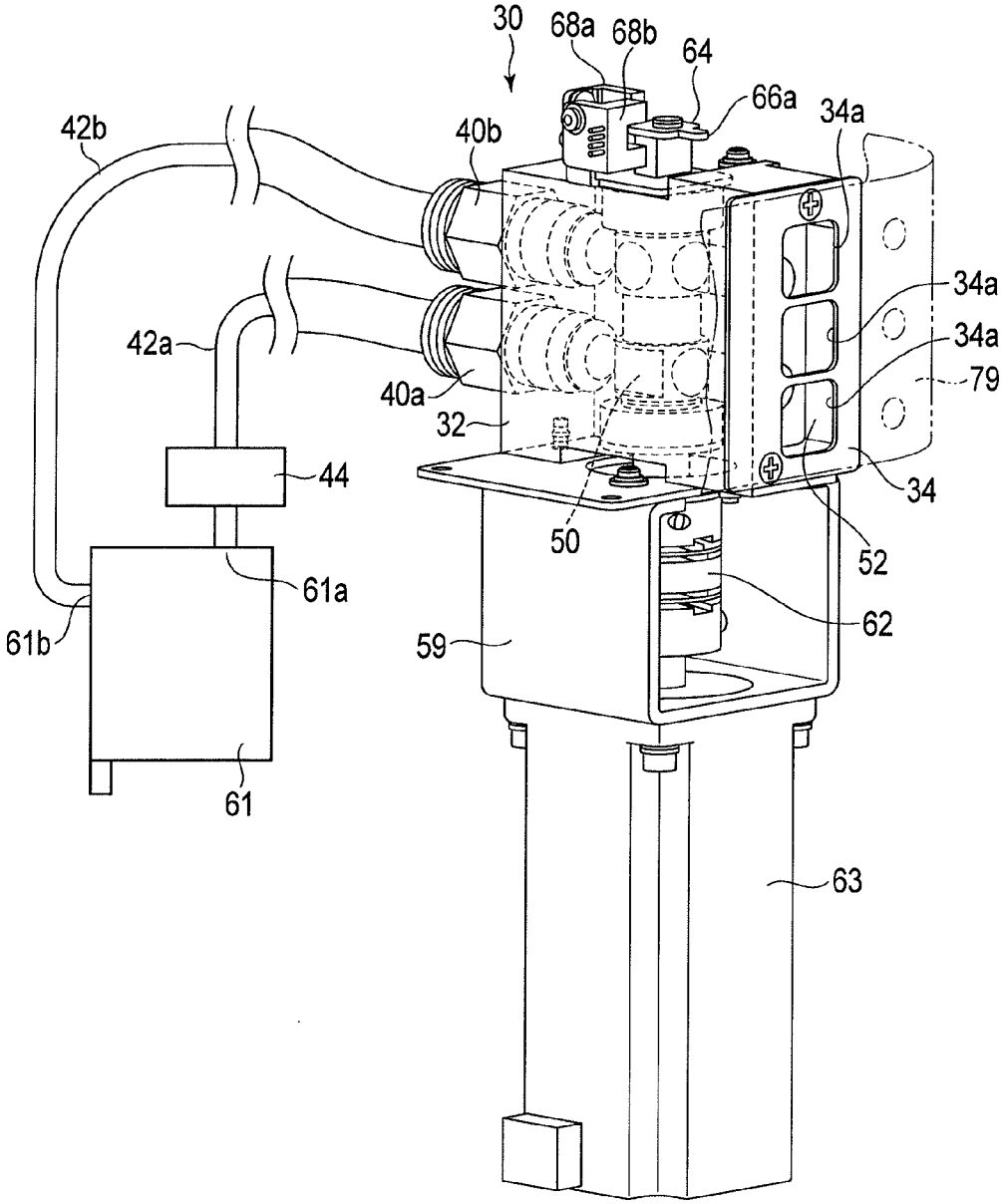
FIG. 4 is a perspective view showing the air drawing source and valve device of the pickup device.
Figure 5:
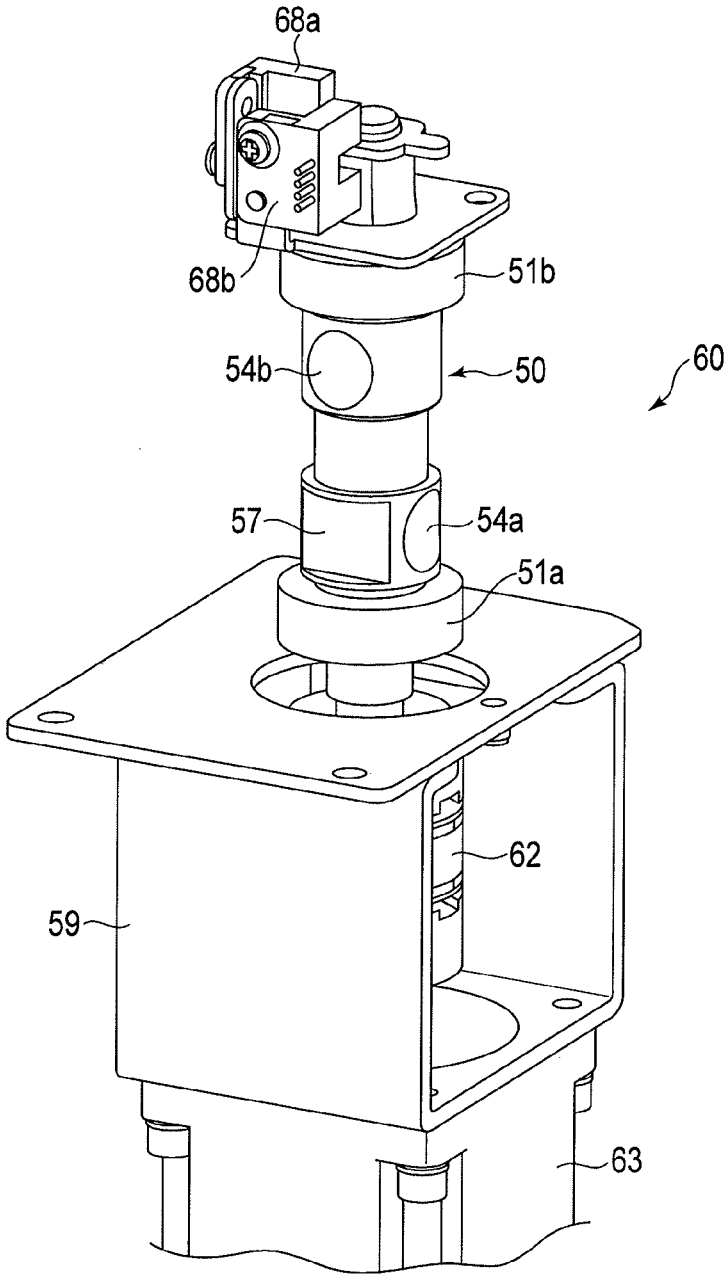
FIG. 5 is a perspective view showing the valve member and driving source of the valve device.
Figure 6:
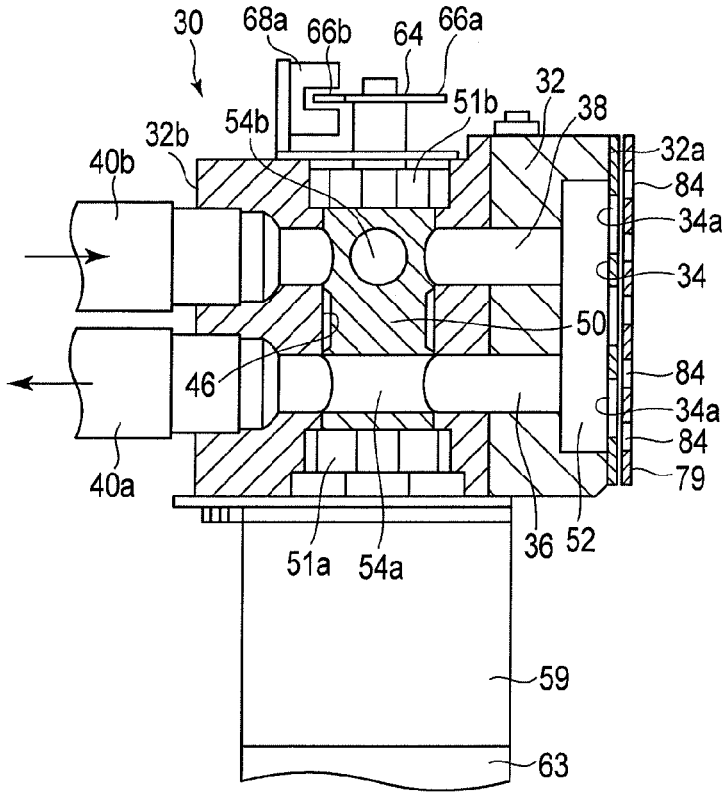
FIG. 6 is a cutaway sectional view showing the main body block of the valve device.
Figure 7:
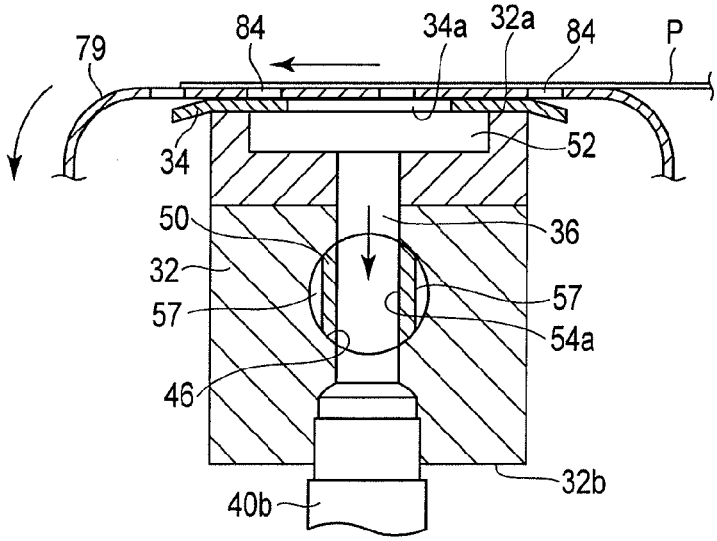
FIG. 7 is a sectional view showing the valve device.

Next, a valve device 30 of the pickup mechanism 56 will be explained in detail. FIG. 4 is a perspective view showing the valve device. FIG. 5 is a perspective view showing the valve member of the valve device. FIGS. 6 and 7 are sectional views showing the valve device.

As shown in FIGS. 4, 6, and 7, the valve device 30 has an almost rectangular parallelepiped main body block 32. The main body block 32 is arranged so that a front surface 32*a* is adjacent to and faces the rear surface side of the pickup belt 79. The air chamber 52 constructed by a rectangular recess is formed in the main body block 32, and open to the front surface 32*a* of the main body block 32. A guide plate 34 configured to guide the pickup belt 79 is attached to the front surface 32*a* of the main body block 32, and covers the opening of the air chamber 52. A plurality of openings are formed side by side in the guide plate 34 and communicate with the air chamber 52.

A first air hole (negative pressure-side air hole) 36 and second air hole (positive pressure-side air hole) 38 are formed in the main body block 32 to extend through it. The first and second vent holes extend almost horizontally, are formed to be parallel to each other, and are positioned at an interval from each other in the vertical direction.

The first air hole 36 is formed to have a circular section. One end of the first air hole 36 communicates with the air chamber 52, and its other end is open to a rear surface 32*b* of the main body block 32. A joint 40*a* for a pipe is connected to the other end of the first air hole 36. The joint 40*a* is connected to a negative pressure port 61*a* of the vacuum pump 61 via a pipe 42*a*. With this structure, the first air hole 36 communicates with the negative pressure port 61*a* of the vacuum pump 61 via the pipe 42*a*. An air filter 44 is inserted midway along the pipe 42*a*.

The second air hole 38 is formed to have a circular section almost equal in diameter to the first air hole 36. One end of the second air hole 38 communicates with the air chamber 52, and its other end is open to the rear surface 32*b* of the main body block 32. A joint 40*b* for a pipe is connected to the other end of the second air hole 38. The joint 40*b* is connected to a positive pressure port 61*b* of the vacuum pump 61 via a pipe 42*b*. With this structure, the second air hole 38 communicates with the positive pressure port 61*b* of the vacuum pump 61 via the pipe 42*b*.

An engaging hole 46 is formed near the center of the main body block 32 to extend vertically. The engaging hole 46 extends across the first and second air holes 36 and 38. In this case, the engaging hole 46 extends perpendicularly to the first and second air holes 36 and 38. The engaging hole 46 is formed to have a circular section larger in diameter than the first and second air holes 36 and 38. The upper end of the engaging hole 46 has an opening in the upper surface of the main body block 32, and its lower end is open to the lower surface of the main body block 32.

A rod-shaped, e.g., almost columnar valve member 50 is fitted in the engaging hole 46 to be freely rotatable. The valve member 50 is formed to be almost equal in length to the engaging hole 46. The two ends of the valve member 50 in the axial direction are supported by bearings 51*a* and 51*b* attached to the main body block 32. The valve member 50 rotates about its central axis to open and close the first air hole 36 and the second air hole 38.

As shown in FIGS. 5, 6, and 7, a first communication hole 54*a* and second communication hole 54*b* equal in diameter to the first air hole 36 and second air hole 38 are formed in the valve member 50 to extend through it in a direction perpendicular to the central axis of the valve member. The first communication hole 54*a* is arranged at a height position where it can communicate with the first air hole 36. The second communication hole 54*b* is arranged at a height position where it can communicate with the second air hole 38. The first communication hole 54*a* and second communication hole 54*b* are formed to shift from each other at a predetermined angle, e.g., 90° in the rotational direction of the valve member 50. Two relief grooves 57 are formed at the same height position as that of the first communication hole 54*a* on the outer surface of the valve member 50. The relief grooves 57 extend parallelly to the first communication hole 54*a*, and are positioned on the two sides of the first communication hole 54*a* in the radial direction.

As shown in FIGS. 4, 5, and 6, an AC servo motor 63 is attached to the lower surface side of the main body block 32 via a bracket 59. The rotating shaft of the AC servo motor 63 extends coaxially with the valve member 50. The rotating shaft of the AC servo motor 63 is connected to the lower end of the valve member 50 via a coupling 62. The AC servo motor 63 can rotate the valve member 50 at each predetermined angle in a predetermined direction.

A sensor dog (portion to be detected) 64 is attached to the upper end of the valve member 50, and can rotate together with the valve member 50. The sensor dog 64 includes a pair of shield plates 66*a* and 66*b* which extend on the two sides of the central axis of the valve member 50. The shield plates 66*a* and 66*b* are spaced apart from each other by 180° about the central axis of the valve member 50, and are arranged parallelly to the axial direction of the first communication hole 54*a* of the valve member 50. That is, the paired shield plates 66*a* and 66*b* are installed on the two sides of the first communication hole 54*a* in the axial direction of the first communication hole 54*a*.

As shown in FIGS. 4, 5, 6, 8, and 9, first and second sensors 68*a* and 68*b* are arranged at the upper surface portion of the main body block 32 to detect the positions of the shield plates

Figure 8:
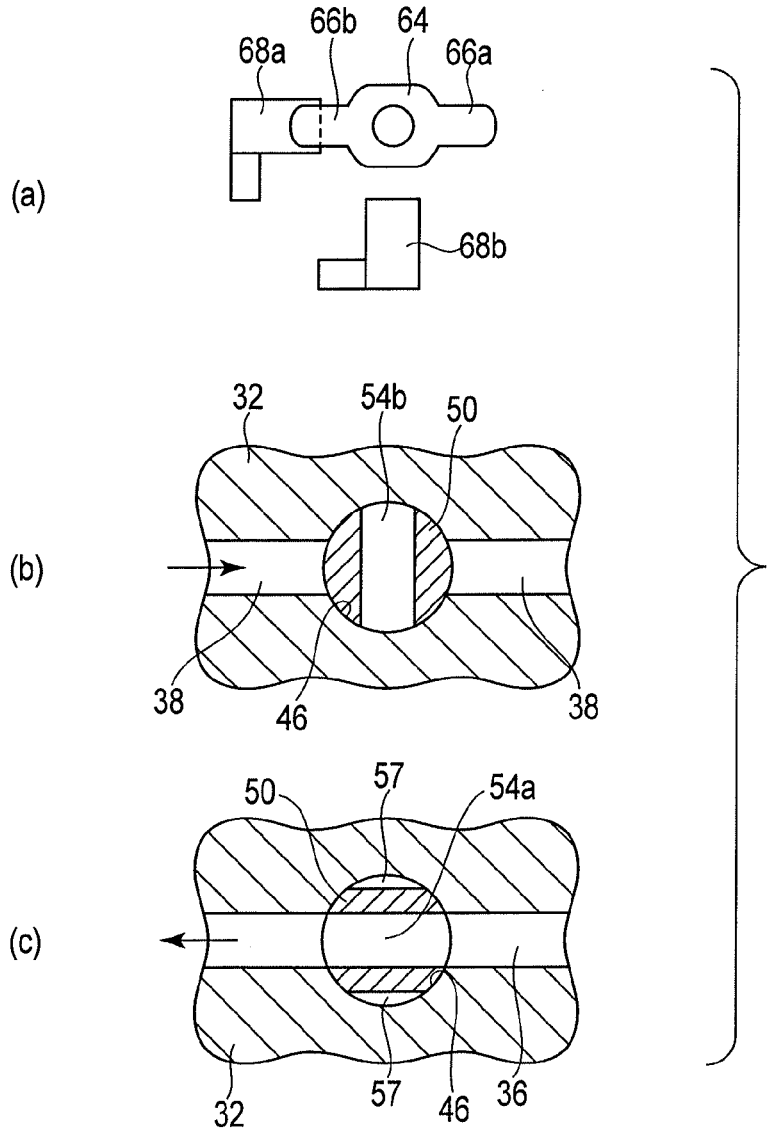
FIG. 8 is a sectional view showing a state in which the valve device is switched to a negative pressure setting position.
Figure 9:
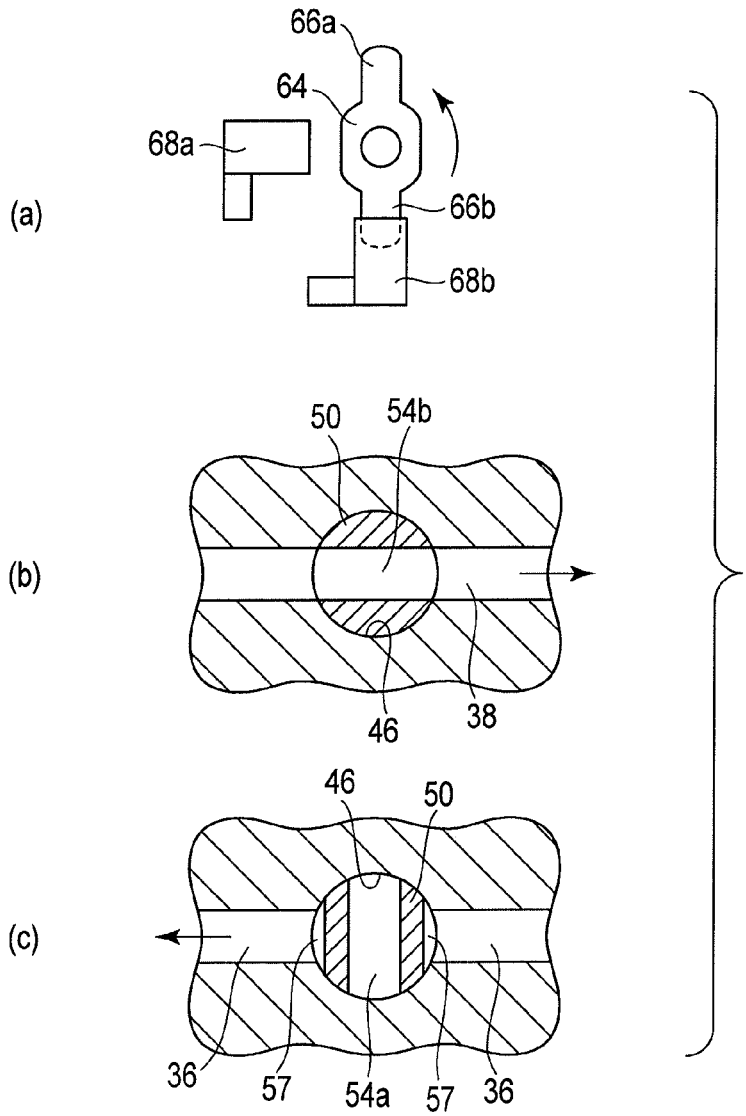
FIG. 9 is a sectional view showing a state in which the valve device is switched to a positive pressure setting position.

66*a* and 66*b* of the sensor dog 64. The first and second sensors 68*a* and 68*b* are spaced apart from each other at 90° in the rotational direction of the valve member 50. As shown in FIG. 8, the first sensor 68*a* is arranged at a position where it detects the shield plate 66*a* or 66*b* when the valve member 50 pivots to a negative pressure setting position where the first communication hole 54*a* of the valve member 50 is aligned with the first air hole 36 of the main body block 32. As shown in FIG. 9, the second sensor 68*b* is arranged at a position where it detects the shield plate 66*a* or 66*b* when the valve member 50 pivots to a positive pressure setting position where the second communication hole 54*b* of the valve member 50 is aligned with the second air hole 38 of the main body block 32. Note that the first and second sensors 68*a* and 68*b* are, e.g., photoelectric sensors.

In the valve device 30 having the above-described arrangement, when the AC servo motor 63 pivots the valve member 50 to the negative pressure setting position shown in FIG. 8, the shield plate 66*a* or 66*b* of the sensor dog 64 cuts off the optical axis of the first sensor 68*a*. Then, the first sensor 68*a* becomes dark. In response to the detection of the shield plate by the first sensor 68*a*, a controller (not shown) stops the AC servo motor 63. At the negative pressure setting position, the first communication hole 54*a* of the valve member 50 is aligned with the first air hole 36 of the main body block 32, releasing the first air hole 36. The air chamber 52 thus communicates with the negative pressure port of the vacuum pump 61 via the first air hole 36, first communication hole 54*a*, and pipe 42*a*. In the state in which the valve member 50 has pivoted to the negative pressure setting position, the second communication hole 54*b* of the valve member 50 does not communicate with the second air hole 38 of the main body block 32, and the valve member 50 closes the second communication hole 54*b*. Accordingly, the air chamber 52 does not communicate with the positive pressure port 61*b* of the vacuum pump 61. The air chamber 52 is evacuated by the vacuum pump 61 to have a negative pressure, draws the postal item P via the through holes 84 of the pickup belt 79, and sucks it to the pickup belt 79.

As shown in FIG. 9, when the AC servo motor 63 pivots the valve member 50 to the positive pressure setting position, the shield plate 66*a* or 66*b* of the sensor dog 64 cuts off the optical axis of the second sensor 68*b*. Then, the second sensor 68*b* becomes dark, detecting the shield plate. In response to the detection of the shield plate by the second sensor 68*b*, the controller (not shown) stops the AC servo motor 63. At the positive pressure setting position, the second communication hole 54*b* of the valve member 50 is aligned with the second air hole 38 of the main body block 32, releasing the second air hole 38. The air chamber 52 communicates with the positive pressure port 61*b* of the vacuum pump 61 via the second air hole 38, second communication hole 54*b*, and pipe 42*b*. In the state in which the valve member 50 has pivoted to the positive pressure setting position, the first communication hole 54*a* of the valve member 50 does not communicate with the first air hole 36 of the main body block 32, and the valve member 50 closes the first communication hole 54*a*. Hence, the air chamber 52 does not communicate with the negative pressure port 61*a* of the vacuum pump 61, and stops evacuation of the air chamber 52. The air chamber 52 is pressurized by the vacuum pump 61 to have a positive pressure, and stops sucking the postal item P via the through holes 84 of the pickup belt 79.

As described above, the inside of the air chamber 52 can be switched between a negative pressure and a positive pressure by pivoting the valve member 50 by the AC servo motor 63 at every 90° in one direction. When sucking a postal item by the air chamber 52, dust or dirt may be sucked into the first air hole 36 and first communication hole 54*a* and enter the interval between the inner surface of the engaging hole 46 and the valve member 50. In this case, the dust or dirt may hinder the rotating operation of the valve member. To prevent this, in the embodiment, the relief groove 57 is formed on the outer surface of the valve member 50. If dust or dirt enters the interval between the inner surface of the engaging hole 46 and the valve member 50, it is temporarily collected in the relief groove 57 upon rotation of the valve member 50. When the valve member 50 is rotated to a position where the relief groove 57 is open to the first air hole 36, the dust or dirt is discharged from the relief groove to the first air hole 36. A smooth operation of the valve member 50 can therefore be maintained.

In the pickup device 10 having the above-described arrangement, while the valve member 50 of the valve device 30 pivots to the negative pressure setting position, as shown in FIG. 2, the vacuum pump 61 is operated to evacuate the inside of the air chamber 52 at a maximum drawing force and set a negative pressure. Then, the negative pressure acts on the postal item P supplied to the pickup position S via the large number of through holes 84 of the pickup belt 79 traveling in the direction indicated by the arrow D, thereby sucking the postal item P to the surface of the pickup belt 79. The sucked postal item P is picked up from the pickup position S onto the conveyance path 101 along with the travel of the pickup belt 79. After the air chamber 52 is evacuated for a predetermined period to pick up the postal item P, the valve member 50 of the valve device 30 is pivoted to the positive pressure setting position and the evacuation is stopped. In addition, the air chamber 52 is caused to communicate with the positive pressure side of the vacuum pump 61 and set a positive pressure in the air chamber 52. Accordingly, the suction of the postal item P is canceled, and the postal item P is separated from the pickup belt 79. After the trailing end of the first postal item P passes through the sub-chamber 60, the sub-chamber 60 sucks and stops the second postal item to prevent pickup of two postal items. Further, the assist roller 67 sucks the postal item P and feeds it to the downstream side in the pickup direction D. By repeating these operations in a predetermined cycle, the pickup device 10 picks up one by one the postal items P placed on the input portion 24, and feeds them to the conveyance path 101.

The pickup mechanism 56 feeds the postal items P at the pickup position S one by one onto the conveyance path 101. When a plurality of postal items P are fed onto the conveyance path 101 while overlapping each other, the separation portion 53 separates them one by one.

In the postal item processing apparatus having the above-described arrangement, the valve device 30 includes the air chamber 52, the main body block in which the first and second air holes are formed, and the freely rotatable rod-shaped valve member 50 arranged to cross the first and second air holes. The air chamber 52, and the valve member 50 for switching air between a positive pressure and a negative pressure can be arranged to be close to each other. The first and second air holes between the valve member 50 and the air chamber 52 can be shortened to decrease the inner volumes of the air holes. This makes it possible to quickly switch the air chamber 52 between a positive pressure and a negative pressure. Hence, paper sheets can be picked up and separated reliably at a high speed.

Since the valve member functioning as a valve has a simple structure obtained by only forming holes in a column, the inertia can be decreased, compared to a disk-shaped valve member. Thus, the switching operation of the valve member, i.e., rotation can be performed quickly. At the same time, the load on the AC servo motor can be reduced to downsize the motor. The gap between the valve member and the main body block can be managed by the fitting crossover between the engaging hole of the main body block and the valve member. This facilitates the manufacturing and management of the valve device. Air leakage of the valve device can also be reduced. Further, the valve member has a structure simpler than that of the disk-shaped valve, and the manufacturing cost can be reduced.

From this, there is provided a paper sheet pickup device capable of stably picking up paper sheets at a high speed.

In the embodiment, for example, a paper sheet to be processed is not limited to a postal item, and the present invention is applicable to various paper sheets. The rotational position of the valve member may be detected by another sensor such as a rotary encoder.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper sheet pickup device comprising:

an input portion configured to place a plurality of paper sheets while overlapping each other;

a pickup member configured to pick up, one by one, the paper sheets present at a pickup position of the input portion;

an air drawing source configured to draw air via the pickup member and suck the paper sheet to the pickup member; and a valve device configured to be interposed between the pickup member and the air drawing source, and switch supply of a negative pressure and a positive pressure to the pickup member, wherein the valve device includes:

a main body block configured to be arranged on a rear surface side of the pickup member to face the rear surface side;

an air chamber configured to be formed in the main body block and be open to the pickup member;

a first air hole configured to be formed in the main body block to extend through the main body block, and have one end communicating with the air chamber and the other end connected to a negative pressure side of the air drawing source;

a second air hole configured to be formed in the main body block to extend through the main body block, and have one end communicating with the air chamber and the other end connected to a positive pressure side of the air drawing source;

a rod-shaped valve member configured to be arranged in the main body block to cross the first air hole and the second air hole, and rotate to alternately open and close the first air hole and the second air hole; and a driving source configured to rotate the valve member.

2. The device according to claim 1, wherein the main body block includes an engaging hole configured to extend to cross the first air hole and the second air hole, the valve member is formed into a columnar shape and fitted in the engaging hole to freely rotate about a central axis, the valve member includes a first communication hole communicable with the first air hole and a second communication hole communicable with the second air hole, and the first communication hole and the second communication hole shift from each other at a predetermined angle in a rotational direction of the valve member.

3. The device according to claim 2, wherein the first communication hole and the second communication hole are arranged at an angle of 90° between the first communication hole and the second communication hole.

4. The device according to claim 2, wherein the first air hole and the second air hole extend parallelly to each other, and the engaging hole extends perpendicularly to the first air hole and the second air hole.

5. The device according to claim 3, wherein the first air hole and the second air hole extend parallelly to each other, and the engaging hole extends perpendicularly to the first air hole and the second air hole.

6. The device according to claim 2, wherein the valve member includes a relief groove configured to be arranged outside the first communication hole and be communicable with the first communication hole.

7. The device according to claim 3, wherein the valve member includes a relief groove configured to be arranged outside the first communication hole and be communicable with the first communication hole.

8. The device according to claim 1, wherein the valve device includes a portion to be detected configured to be arranged on the valve member, and a first sensor and second sensor configured to detect the portion to be detected and a rotational position of the valve member.

9. The device according to claim 1, wherein the driving source includes a servo motor configured to be coupled to the valve member, and rotate the valve member at every predetermined angle in one direction.

10. The device according to claim 1, wherein the pickup member includes a looped pickup belt configured to have a plurality of suction holes and travel between the air chamber and a paper sheet.

11. A paper sheet processing apparatus including a paper sheet pickup device defined in claim 1, comprising:

a determination unit configured to determine a sorting destination of a paper sheet picked up by the paper sheet pickup device; and a stacking unit configured to stack the paper sheet sorted based on a result of the determination of the sorting destination by the determination unit.

* * * * *